US005249380A

United States Patent [19]

Fast

[11] Patent Number: 5,249,380

[45] Date of Patent: Oct. 5, 1993

[54] IDENTIFICATION TAG HOLDER FOR GAS CYLINDER

[76] Inventor: Jacob Fast, 6850 NW. 12th Ave., Ft. Lauderdale, Fla. 33309

[21] Appl. No.: 751,068

[22] Filed: Aug. 28, 1991

[51] Int. Cl.[5] ..... G09F 3/10

[52] U.S. Cl. ..... 40/299; 40/306

[58] Field of Search ..... 40/299, 306, 307, 309, 40/310, 331, 539; 248/152, 174; 211/73, 85, 70.1

[56] References Cited

U.S. PATENT DOCUMENTS

| | | | |
|---|---|---|---|
| 813,447 | 2/1906 | Pope | 40/299 X |
| 2,252,235 | 8/1941 | Snelling | 211/73 X |
| 2,340,719 | 2/1944 | Walter | 40/310 |
| 3,196,567 | 7/1965 | Boehmer et al. | 40/310 |
| 4,549,568 | 10/1985 | Trail | 40/306 X |
| 4,598,489 | 7/1986 | Hoffman | 40/299 X |

*Primary Examiner*—Kenneth J. Dorner
*Assistant Examiner*—Brian K. Green
*Attorney, Agent, or Firm*—Jacobson, Price, Holman & Stern

[57] ABSTRACT

An information tag holder for use on the screw-threaded neck of a gas cylinder is made from a plastic sheet which has at least two thread-engagement portions with cut-outs for frictionally engaging over the screw-threads, and a tag supporting surface between the thread-engagement portions. In use, the holder is folded transversely, so that the cut-outs in the respective portions are in register and the holder is applied in this manner to the cylinder. The respective thread-engagement portions are differently dimensioned so that when the cut-outs are in register, the tag supporting surface is inclined.

8 Claims, 2 Drawing Sheets

IDENTIFICATION TAG HOLDER FOR GAS CYLINDER

BACKGROUND OF THE INVENTION

This invention relates to an identification tag holder which is suitable for supporting product information on a container, in particular, a gas cylinder in which a gas is stored under pressure.

Presently provision is made for identification or product information tags on a gas cylinder by means of a molded collar which is located around the screw-threaded top of the gas cylinder and held in position by means of a protective cap which screws onto the screw-threaded top of the gas cylinder. The identification tag is then applied to the collar.

However, the collar has the disadvantage that it is large and costly. The collar also requires the protective cap to be screwed on to secure it in place and it requires removal of the screw cap if it is to be removed or replaced. If the cap is not in place, the collar can easily fall off if the gas cylinder is manhandled. Thus, it requires the screw cap to be in place if it is to remain securely in position on the gas cylinder.

It is an object of the present invention to overcome the above-mentioned disadvantage and to provide an identification tag holder which is not costly and which is light and which does not require the screw cap to be screwed on the top of the gas cylinder to maintain it in its place on the top of the gas cylinder.

In practice, it is sometimes desirable that an identification tag be provided on at least two opposite sides of a gas cylinder. The known collar only has provision for supporting a label on one side thereof. It is, accordingly, also an object of the present invention to provide an identification tag holder which can support a label on at least two opposite sides thereof.

Another object of the invention is to provide an identification tag holder for use on a gas cylinder wherein the tag is shielded from the elements.

SUMMARY OF THE INVENTION

According to the invention, there is provided an identification tag holder for location on a screw-threaded connection part of a container, comprising an elongate member of sheet material divided into at least two thread-engagement portions by a pair of transverse fold lines, an information tag supporting surface being defined between the fold lines, which information supporting surface is located transversely of the thread-engagement portions when the thread-engagement portions are superimposed on each other by folding the elongate member along the fold lines; a thread-engaging cut-out in each of the thread-engagement portions for engaging over the screw-thread on the connection part of a container and wherein the cut-outs in the thread-engagement portions are in register with each other when the end portions are superimposed on each other by folding the elongate member along the fold lines. The cut-outs are of a size and shape to engage frictionally with the screw-thread on the connection part of the container so that the tag holder remains in place on the screw-threaded portion without the need of the protective screw cap to be in place. To enhance the engagement between the cut-outs and the screw-thread on the connection part of the container, the cut-outs may be circular with radial slits spaced around their peripheries, or may have opposed arcs of different diameters, the smaller diameter of which is slightly smaller than the outer diameter of the screw-thread on which the holder is to be used.

The respective thread-engagement portions may be differently dimensioned so that the information supporting surface is inclined with respect to such portions when the cut-outs are in register with each other. Thus, the tag holder can be applied to the container with the supporting surface downwardly and inwardly inclined whereby an information tag thereon is shielded from the elements The sheet material of which the identification tag is made is preferably a plastic material, which is light and is easily die cut into the required shape to form the identification tag holder, thus obviating the need for a molded collar which is heavy and costly.

The tag holder may have only two thread-engagement portions with an intervening information supporting surface, where only one such surface is required. Alternatively, the tag holder may have three thread-engagement portions with respective information surfaces interposed therebetween where two oppositely disposed such surfaces are required.

Additional features and advantages of the invention will become apparent from the following description and claims read in conjunction with the attached drawings.

DESCRIPTION OF PREFERRED EMBODIMENTS

Figures 1, 2, 3, 4, 5:
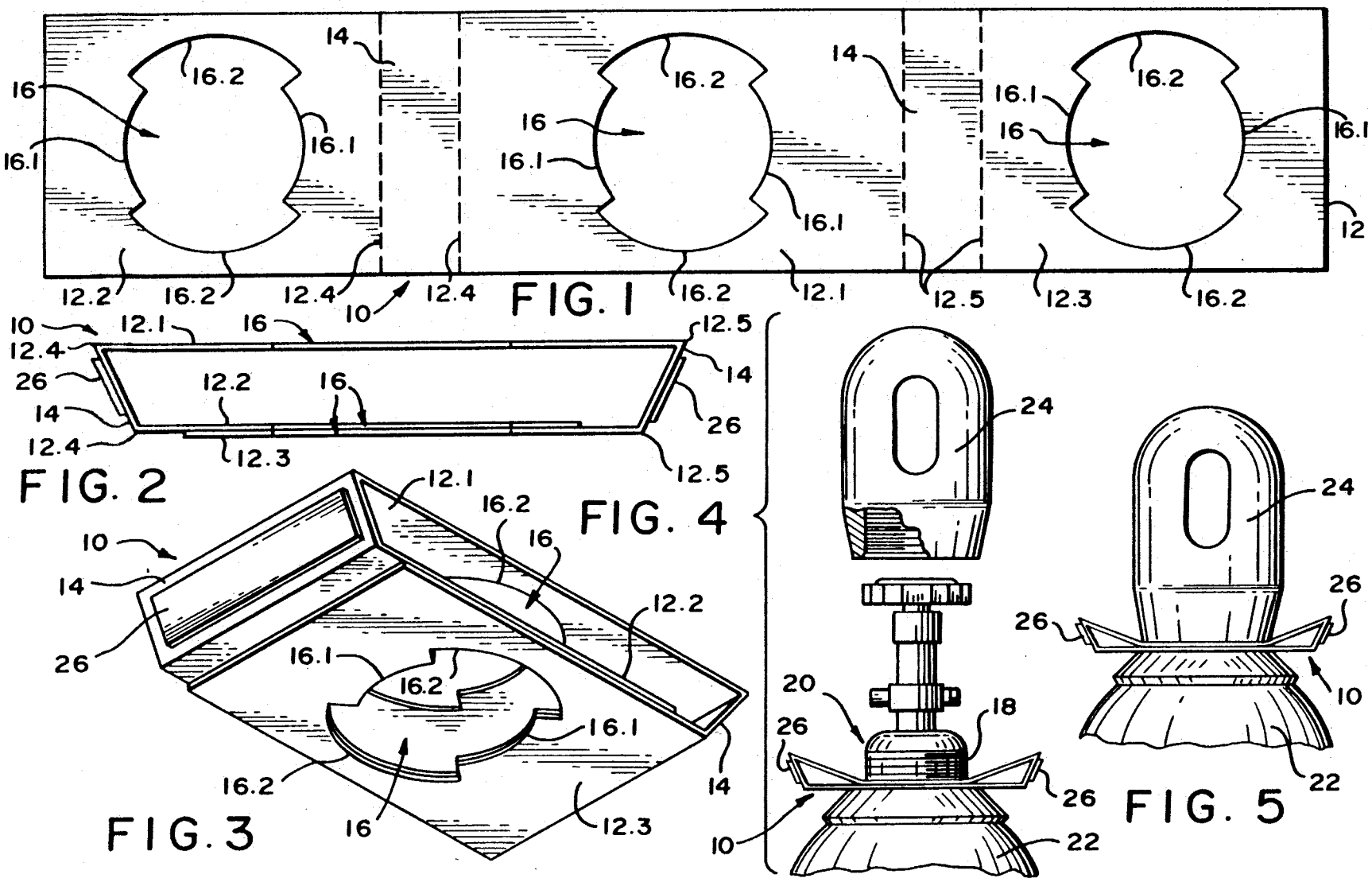
FIG. 1 is a plan view of an identification tag holder for a gas cylinder, the tag holder being shown in a flat condition prior to being folded along its several fold lines.
FIG. 2 is a side view of the identification tag holder of FIG. 1, on a different scale, and showing the tag holder folded along its several fold lines to place it in condition ready for location on the screw-threaded part on the top of a gas cylinder.
FIG. 3 is a perspective view of the information tag holder of FIG. 2.
FIG. 4 a fractional side view of the top of a gas cylinder showing the tag holder in position on the screw-threaded connection part on the top of the gas cylinder and with the screw-threaded protective cap removed from the top of the gas cylinder.
FIG. 5 is fractional side view of the top of a gas cylinder with the tag holder in position around the screw-threaded part on top of the gas cylinder and with the protective cap screwed into place.

Referring firstly to FIGS. 1–3 of the drawings, reference numeral 10 generally indicates an identification tag holder comprising an elongate member of plastic sheet material 12 divided into a middle thread-engagement portion 12.1 and two end thread-engagement portions 12.2 and 12.3 by pairs of transverse fold lines 12.4 and 12.5. A tag supporting surface 14 is defined between each of the pairs of fold lines 12.4 and 12.5, and, as shown in FIGS. 2 and 3, the tag supporting surfaces 14 are located transversely of the middle portion 12.1 and end portions 12.2 and 12.3 when the end portions 12.2 and 12.3 are superimposed on each other by folding the elongate member 12 along the two pairs of fold lines 12.4 and 12.5.

A generally circular cut-out 16 is provided in each of the middle 12.1 and end portions 12.2 and 12.3 for engaging with the screw-threaded position 18 on the connection part 20 at the top of a gas cylinder 22. The cut-outs 16 are so positioned that they are in register with each other when the end portions 12.2 and 12.3 are superimposed on each other, as shown in FIG. 3. Also, the middle thread-engagement portion 12.1 is somewhat longer than the end portions 12.2 and 12.3 so that when the respective cut-outs 16 are superimposed, the surfaces 14 becomes inclined (downwardly and inwardly in the orientation shown in FIGS. 2 and 3.)

Each cut-out has a pair of diametrically opposed smaller arc sections 16.1 and a pair of diametrically opposed larger arc sections 16.2. The diameter of the smaller arc sections 16.1 is slightly less than the external diameter of the screw-threaded portion 18 of a cylinder on which the holder is to be used so that the cut-outs 16 will engage with the screw-threads frictionally when the tag holder 10 is pushed down around the screw-threaded portion 18 onto the top of the gas cylinder 22. (See FIGS. 4 and 5). This engagement is facilitated by the fact that the edge of the smaller arc portions 16.1 can flex sideways somewhat. In this way the tag holder 10 is secured in place due to the engagement of the cut-outs 16 with the screw-threaded portion 18, as shown in FIG. 4, and it is not necessary for the protective cap 24 of the gas cylinder to be in place in order to maintain the tag holder 10 in its place. Thus, the gas cylinder 22 can be moved around and tilted to its side and the tag holder 10 will not accidentally fall off the top of the gas cylinder as would be the case with the known collar type tag holders presently in use. However, the fact that the tag holder 10 remains in position by itself, does not prevent the protective cap from being screwed on to the top of the gas cylinder with the tag 10 in its place, as shown in FIG. 5.

With reference to FIGS. 2–5, it can be seen that the tag supporting surfaces 14 are slightly inclined inwardly and downwardly when the tag holder 10 is in its folded condition and also when it is in place on top of a gas cylinder so that the identification tags are easily legible, protected from the elements and not subject to dust accumulation.

A product information or identification tag 26 can be attached to each of the two tag supporting surfaces 14 on the two sides of a gas cylinder. The holder can however be rotated around the screw-threads to adjust the rotational position of surfaces 14.

Figure 6:
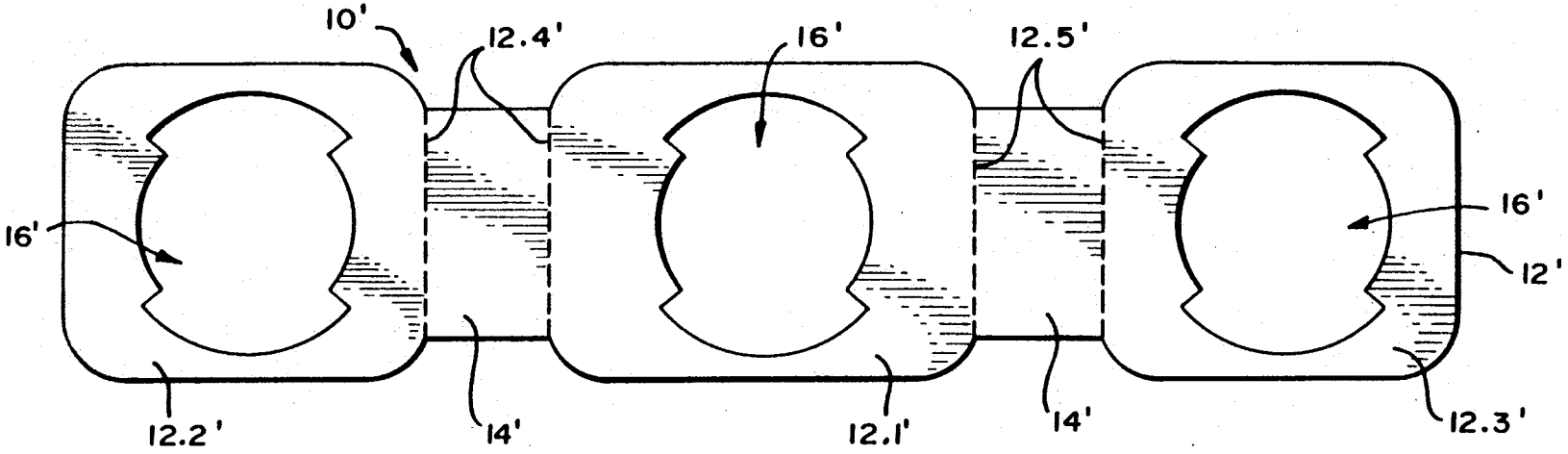
FIG. 6 is a plan view of a further embodiment of the identification tag holder.

FIG. 6 shows a modified tag holder 10' in which each of the thread-engagement portions 12.1', 12.2' and 12.3' has rounded corners so that in use the holder does not present sharp edges. In every other respect, the tag holder is similar to that shown in FIGS. 1–5 both in structure and in use.

Figure 8:
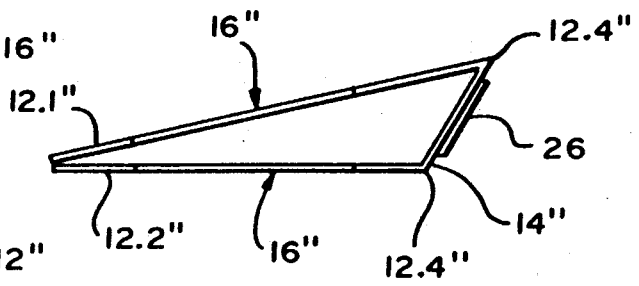
FIG. 8 is an elevational view of the tag holder of FIG. 7 shown in a folded condition ready for use.
Figure 7:
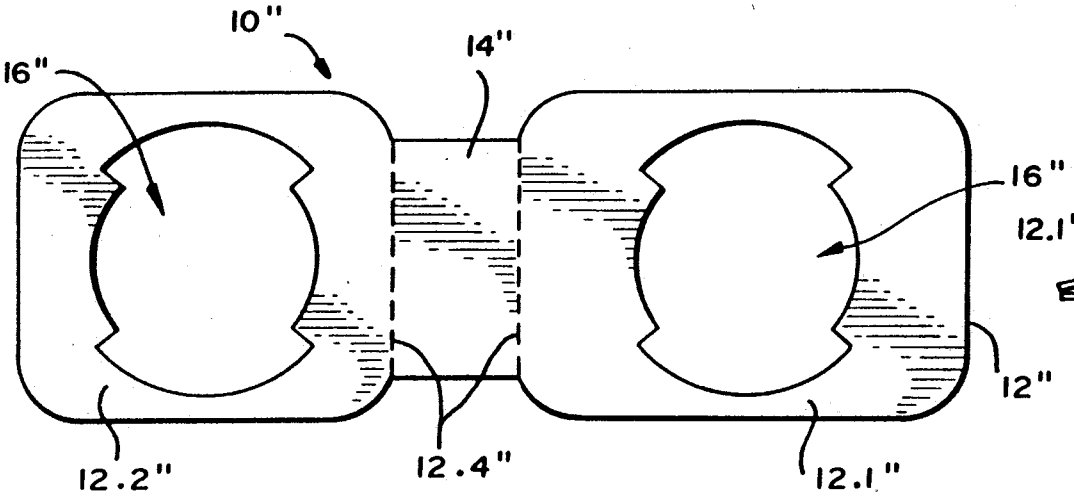
FIG. 7 is a plan view of still another embodiment.

FIGS. 7 and 8 show a further modified tag holder 10'' similar to that shown in FIG. 6 but having only two thread-engagement portions 12.1'' and 12.2'' (of unequal lengths) and a single intervening supporting surface 14''. This holder may be used in like manner to the previous embodiments but where only a single identification tag 26 is required. The two-portion holder could alternatively have sharp corners as in FIGS. 1–3.

In all of the embodiments, the holder may be made of clear or translucent plastic, or of black plastic to resist UV ray deterioration.

While only preferred embodiments of the invention have been described herein in detail, the invention is not limited thereby and modifications can be made within the scope of the attached claims.

I claim:

1. An identification tag holder for location on a screw-threaded connection part of a container, comprising:

an elongate member of sheet material divided into at least two thread-engagement portions by a pair of transverse fold lines;

an information supporting surface being defined between the pair of fold lines, which information supporting surface is located transversely of the thread-engagement portions when the thread-engagement portions are superimposed on each other by folding the elongate member along the fold lines;

a generally circular cut-out in each of the thread-engagement portions, the cut-outs being of like configuration and dimensions for frictionally engaging over a screw-thread on a connection part of a container and wherein the cut-outs in the thread-engagement portions are in register with each other when said portions are superimposed on each other by folding the elongate member along the fold lines, wherein the cut-outs have respective peripheries which are each provided with a plurality of first arc segments and a plurality of second arc segments alternating with the first arc segments around the periphery for facilitating engagement between the cut-outs and the screw-thread on the connection part of a container, wherein the second arc segments have a larger radius than the first arc segments.

2. The tag holder according to claim 1, wherein the thread-engagement portions are differently dimensioned so that the information supporting surface is inclined with respect to the thread-engagement portions when the cut-outs are in register with each other.

3. The tag holder according to claim 1 wherein the thread-engagement portions are three in number with respective interposed supporting surfaces.

4. The tag holder according to claim 1, wherein the sheet material is a plastic material.

5. The tag holder according to claim 1 wherein the thread-engagement portions have rounded corners.

6. A combination comprising a gas cylinder and an identification tag holder engaged with a screw-thread on a connection part of the gas cylinder, the tag holder comprising an elongate member of sheet material divided into at least two thread-engagement portions by a pair of transverse fold lines, an information supporting surface defined between the pair of fold lines, the tag holder being folded along the fold lines whereby the thread-engagement portions are superimposed on each other and the information surface is located transversely of the thread engagement portions, and a generally circular cut-out in each of the thread engagement portions, the cut-outs being in register with each other and frictionally engaged around said screw-thread.

7. A combination according to claim 6, wherein the thread-engagement portions are differently dimensioned so that the information supporting surface is inclined relative to an axis of the screw-thread.

8. A combination according to claim 6, wherein the cut-outs have respective peripheries which are each provided with a plurality of first arc segments engaging the screw thread and alternating with second arc segments around the periphery of the cut-out, wherein the second arc segments have a larger radius than the first arc segments.

* * * * *